US007928924B1

(12) United States Patent
Hendrickson

(10) Patent No.: US 7,928,924 B1
(45) Date of Patent: Apr. 19, 2011

(54) VARIABLE POSITION ANTENNA SHIELD

(75) Inventor: Lief M. Hendrickson, San Diego, CA (US)

(73) Assignee: United States of America as represented by Secretary of the Navy, Washington, DC (US)

( * ) Notice: Subject to any disclaimer, the term of this patent is extended or adjusted under 35 U.S.C. 154(b) by 418 days.

(21) Appl. No.: 12/128,531

(22) Filed: May 28, 2008

(51) Int. Cl.
*H01Q 1/52* (2006.01)

(52) U.S. Cl. ..... 343/841; 343/700 MS

(58) Field of Classification Search ..... 343/700 MS, 343/841; 455/575.5
See application file for complete search history.

(56) References Cited

U.S. PATENT DOCUMENTS 5,200,756 A 4/1993 Feller
6,259,896 B1 * 7/2001 Sepponen ..... 455/575.5
6,847,328 B1 1/2005 Libonati et al.
7,701,408 B2 * 4/2010 Bombay et al. ..... 343/841
2003/0103014 A1 6/2003 Birnbaum et al.
2007/0171138 A1 7/2007 Noro
2007/0222582 A1 * 9/2007 Fontijn ..... 340/539.1

OTHER PUBLICATIONS

Sawson Teheri, Jared Buckley, Ramon Alvarado, 915 MHz Cantenna and Patch Antennas Design, Report, 12 pages, www.engr.sjsu.edu/rkwok/EE172/Antenna.pdf.

* cited by examiner

*Primary Examiner* — Tan Ho
(74) *Attorney, Agent, or Firm* — Kyle Eppele; Peter A. Lipovsky

(57) ABSTRACT

A variable position antenna shield (VPAS) is described that provides a mechanism for attenuating radio interference signals and other electromagnetic waves using a movable shield. The VPAS contains an antenna assembly, an antenna, and a patch variably positioned exterior to the antenna, wherein the patch attenuates passage of electromagnetic radiation such that the passage of electromagnetic radiation through the patch is substantially blocked, the patch being variably positioned to affect the directivity pattern of the antenna.

13 Claims, 6 Drawing Sheets

VARIABLE POSITION ANTENNA SHIELD

FEDERALLY-SPONSORED RESEARCH AND DEVELOPMENT

This invention (Navy Case No. 97,354) is assigned to the United States Government and is available for licensing for commercial purposes. Licensing inquiries may be directed to the Office of Research and Technical Applications, Space and Naval Warfare Systems Center, San Diego, Code 73120, San Diego, Calif., 92152; voice 619-553-2778; email T2@spawar.navy.mil.

BACKGROUND

For some receiving antennas, there has been a long-standing need to shield the antenna from electromagnetic interference from a variable and changeable direction relative to the antenna position. Similarly, for some transmitting antennas, there has been a need to reduce the intensity of transmitted signals in a variable and changeable direction relative to the antenna position.

Practitioners have attempted to address these needs by using various forms of radiation shielding devices. However, while the prior art radiation shielding devices fulfill their respective objectives and requirements, the prior art does not disclose a variable position antenna shield (VPAS).

SUMMARY

The foregoing needs are met to a great extent by the apparatuses and methods disclosed herein. In particular, a variable position antenna shield (VPAS) is described that provides a mechanism for attenuating radio interference signals and other electromagnetic waves using a movable shield.

In accordance with one aspect of the present disclosure, a variable position antenna shield is disclosed, comprising: an antenna; and a patch variably positioned exterior to the antenna, wherein the patch attenuates passage of electromagnetic radiation such that the passage of electromagnetic radiation through the patch is substantially blocked, the patch being variably positioned to affect the directivity pattern of the antenna.

In accordance with another aspect of the present disclosure, a variable position antenna shield is disclosed, comprising: means for at least one of transmitting and receiving electromagnetic energy; and means for attenuating propagation of electromagnetic energy, the attenuating means being positioned exterior to the at least one of the transmitting and receiving means, and being variably positioned to affect the directivity pattern of the at least one of the transmitting and receiving means.

In accordance with yet another aspect of the present disclosure, a method for shielding an antenna from undesired electromagnetic energy emanating towards the antenna is provided, comprising: positioning a patch exterior to the antenna, the patch attenuating passage of electromagnetic radiation such that the passage of electromagnetic radiation through the patch is substantially blocked; and moving the patch in a position between the antenna and the undesired electromagnetic energy, wherein the patch affects the directivity pattern of the antenna.

DETAILED DESCRIPTION OF THE EMBODIMENTS

Figure 1:
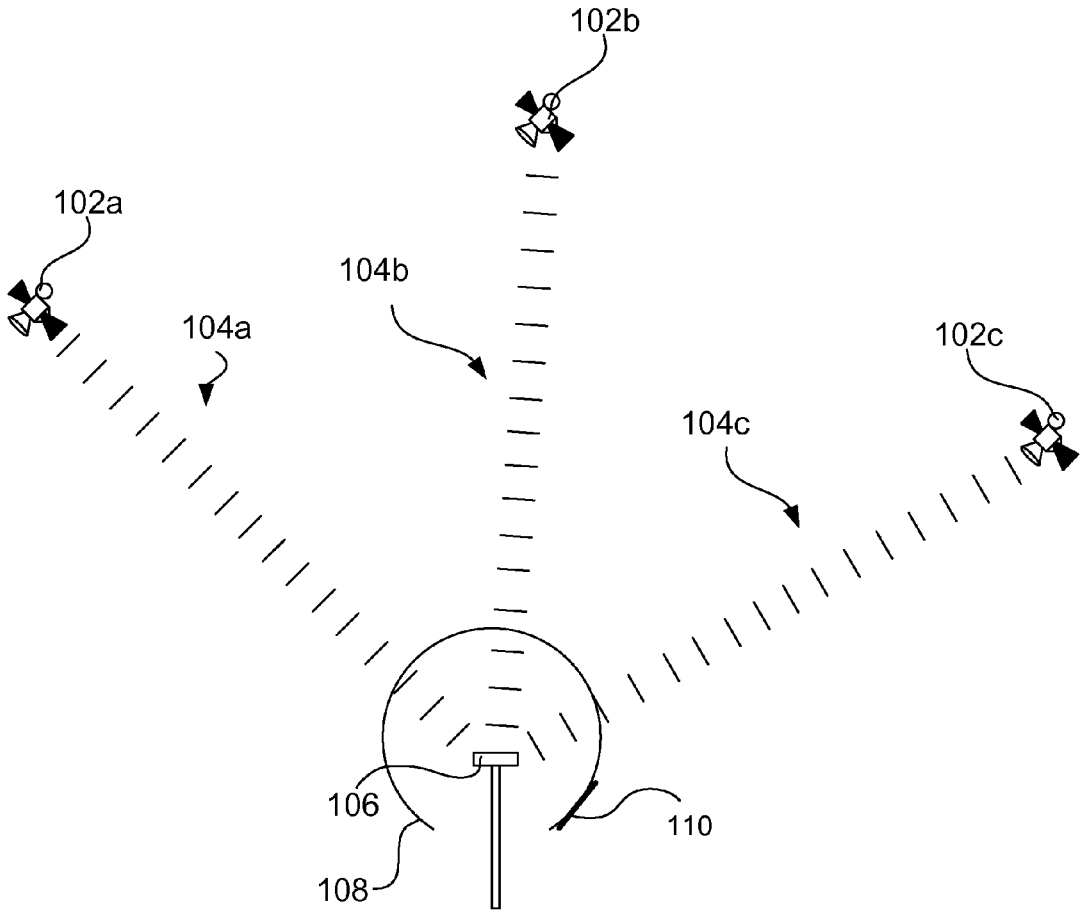
FIG. 1 shows a patch placed on a shell in an inactive condition in accordance with the VPAS described herein.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that such subject matter may be practiced without these specific details.

The use of the VPAS with antennas receiving electromagnetic signals will be discussed first with a detailed description of the characteristics. Use of the VPAS with antennas for transmitting electromagnetic signals will then be discussed with fewer details since the physical characteristics are similar and need not be repeated.

This apparatuses and methods disclosed herein provide means to reduce the signal strength of sources of electromagnetic radiation that would otherwise interfere with antenna reception of desired signals referred to here as "radio waves", whether they are used for radio, television, digital data packets, or other forms of communication. The source of the undesired electromagnetic radiation may be unintentional or intentional. An unintentional source may be a friendly radio station that unknowingly transmits spurious emissions in the same frequency range as the desired signals. Another unintentional source may be electromagnetic emissions from unshielded electrical equipment or equipment that generates undesired electrical activity as a byproduct of its intended function.

An intentional source may be an adversary transmitting interfering electromagnetic signals to prevent successful reception of desired radio waves. The detrimental effect of interfering signals on antenna reception is referred to here as "jamming". In the description that follows, the source of the interfering signals shall be referred to as a "jammer" whether it is an intentional or unintentional source. The disclosed VPAS can operate to reduce the strength of the jammer's signal arriving at the antenna.

In general, it is not necessary to completely eliminate the jammer's signal; rather it is sufficient to attenuate the jammer's signal to a level where it does not prevent reception and processing of the desired signals. The VPAS can cause a combination of reflection and absorption in a manner to attenuate the jammer's signal to a manageable level at the location of the antenna. The VPAS is not limited to a particular waveform or wavelength of interfering electromagnetic radiation since by suitable positioning of the patch, the intensities of all electromagnetic signals arriving from the direction of the patch are eliminated or reduced before they reach the most active part of the antenna.

The shielding element of the VPAS is moved to face the direction of the jammer. The ability to continuously move the shield is advantageous when the direction of the jammer is changing relative to the receiver. This relative motion can result from a moving jammer, from the motion of the radio receiver, or from their combined motion. The movement of the shielding element of the VPAS can be effected by an electromechanical means, such as a motor or actuating device, not shown. Therefore, the VPAS can selectively change the directivity pattern for reception of electromagnetic radiation, as well as minimizing interference that would otherwise hinder reception of a desired signal by a receiving antenna.

The shield in the VPAS includes a strip of material, identified herein as a "patch," to selectively absorb and/or reflect incoming electromagnetic radiation from a direction on the opposite side of the patch. The patch acts much in the same manner in which an umbrella shields its holder from sunlight where the umbrella is pointed in the direction of the sun. The user of an umbrella needs to move the umbrella during the course of the day as the position of the sun changes as well as move the position of the umbrella as the user moves about in order to keep the umbrella between the sun and the user. In a similar manner, the patch is moved to "point" in the direction of the undesired electromagnetic signal. The patch is kept between the location of the undesired signal and the antenna, and is thus a protective barrier to partially prevent adverse electromagnetic radiation caused by the jammer from reaching the antenna by creating a "shadow-zone" so that the full strength of the adverse radiation does not reach the antenna.

The patch kept between the location of the undesired signal and the antenna provides a barrier to the path of undesired electromagnetic radiation. In one embodiment, the patch may be constructed of passive material that is opaque to the passage of electromagnetic radiation. For example, the passive material could be selected from those commonly used for Radio Frequency Interference (RFI) shielding such as a metal sheet or metal mesh. Another example of a passive material could be the use of metallic ink to paint a patch on a transparent shell. Another type of patch may use an electronic circuit which has wires attached thereto (ground wire, signal wires, or power wires). The circuit could be tuned to receive the undesired electromagnetic radiation striking its area and transport the energy of the electromagnetic radiation to ground. Another type of patch could be constructed of a material that reflects the electromagnetic radiation from an undesired direction. Another type of patch could be constructed of a material that absorbs or partially absorbs undesired electromagnetic radiation. The absorber patch could absorb the energy of the electromagnetic radiation by heating up and releasing its heat to the environment thus converting the energy to a form harmless to the function of the receiving antenna. Other types of patches may be used where the strength of the undesired electromagnetic radiation is reduced to a level suitable to the intended operation of the VPAS.

It should be noted that the patch is not required to completely block undesirable incoming electromagnetic radiation; rather the patch can serve to reduce the intensity of the undesirable electromagnetic radiation in order to assist in antenna reception of the desired signals.

In one configuration, the patch is attached to a spherical shell herein called the "structural shell". The attachment could be permanent or temporary. A temporary attachment would allow adjustment of the geometry for different ranges of spatial conditions. The structural shell includes a non-absorbing material that has minimal attenuation of electromagnetic radiation where the patch is not located. An example of such a material is glass or plastic where the type of glass or plastic allows passage of the electromagnetic radiation with minimal attenuation. Motion of the patch relative to the antenna is achieved by rotating the structural shell. When a jamming source is not present, the patch is below the line of sight, and the antenna works the same way it would if the VPAS were not present. The electromagnetic radiation passes through the non-absorbing material of the structural shell with no effective loss of signal strength.

FIG. 1 shows a patch 110 placed on the structural shell 108 in an inactive condition of this sort (reception with no jammer). The antenna system 106 is shown receiving signals 104*a*, 104*b*, and 104*c* from three satellites 102*a*, 102*b*, and 102*c*, respectively. The representative antenna system 106 could be a GPS receiver antenna. However, any antenna that could fit within the structural shell 108 could be used. The size of the structural shell 108 would be appropriately scaled for the size of the antenna.

In operation, the patch 110 is a shielding element, which is moved to face the direction of the undesired incoming electromagnetic interference source. The ability to continuously move the patch 110 is advantageous when the direction of the interference source is changing relative to the receiver. This relative motion can result from a moving interference source, from the motion of the radio receiver, or from their combined motion.

Figure 2:
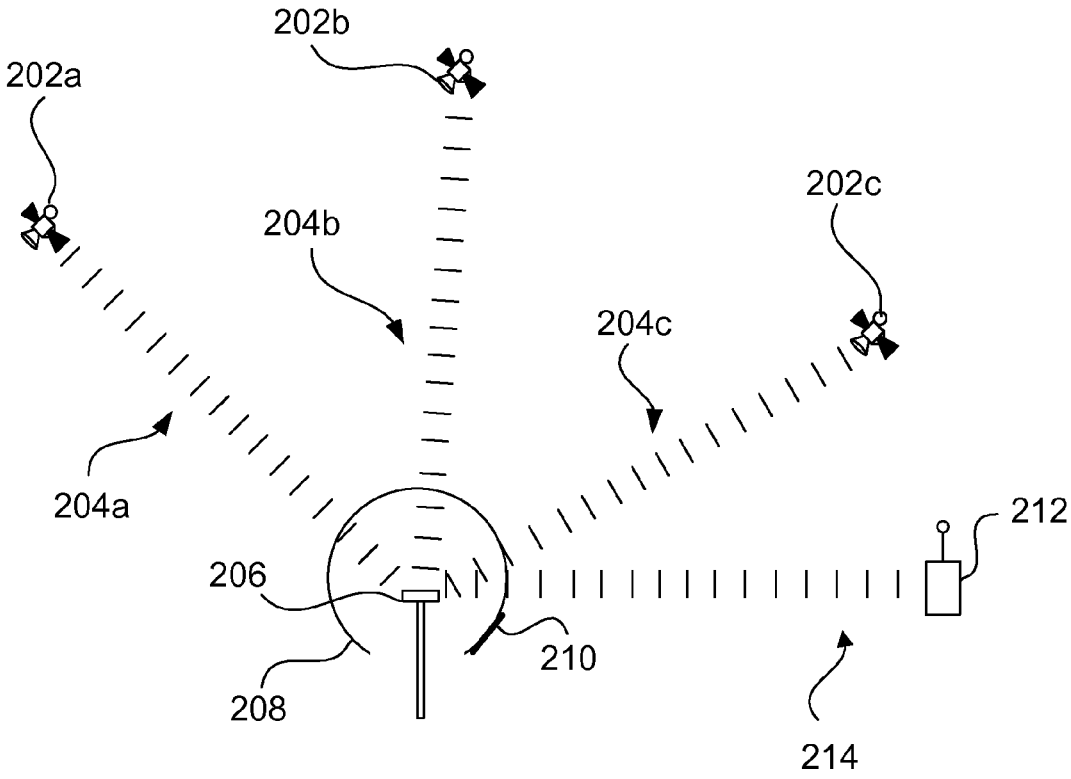
FIG. 2 shows a condition where a jammer is activated in accordance with the VPAS described herein.

FIG. 2 shows a condition where a jammer 212 is activated (jammer interferes with reception). The signal 214 from jammer 212 arrives at the antenna 206 and interferes with reception of other signals. A patch 210 is located on the structural shell 208 in its position before being moved to counter the effect of the jammer 212. The antenna 206 is shown receiving signals 204*a*, 204*b*, and 204*c* from three satellites, 202*a*, 202*b*, and 202*c*, respectively, and signal 214 from jammer 212.

Figure 3:
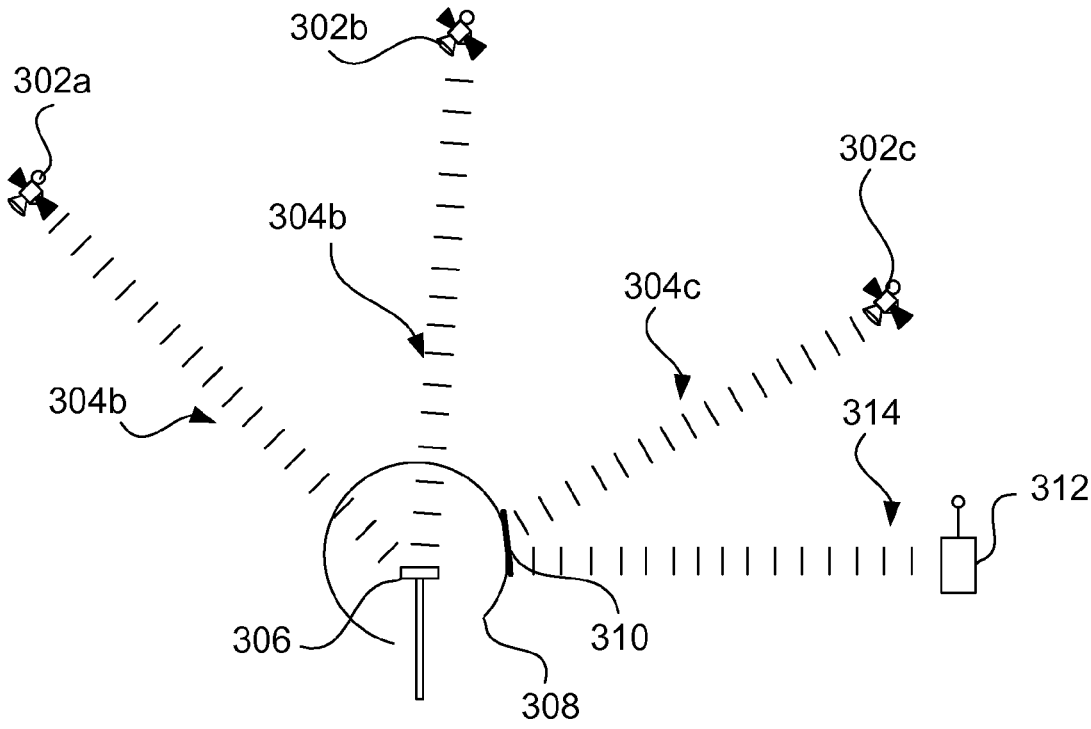
FIG. 3 shows a patch rotated into a position where it shields the antenna from the jamming source in accordance with the VPAS described herein.

FIG. 3 shows the patch 310 rotated into a position where it shields the antenna system 306 from the jamming source 312 (signal 314 from jammer 312 is blocked). The patch 310 might entirely block the signal 314 from the jammer 312, but it only needs to attenuate the jammer signal strength to a level where other signals could still be processed. In this case, the user could choose to block all signals coming from the direction of jammer 312 including desired signal 304*c* from satellite 302*c* and all other desired signals coming from that same direction. In this instance, the number of satellite signals would be reduced but not eliminated by the jammer. In the figures, the satellites could represent GPS satellites. In the case of GPS satellites, there are generally more available GPS satellites than shown with the number reduced here for simplicity. Since successful GPS operation does not require reception of signals from all available satellites, the user could possibly still arrive at a successful GPS solution using signals from GPS satellites in the remaining unblocked directions. The same action applies to signals from other satellite systems and other sources. It should be appreciated that while FIGS. 1-3 are discussed in the context of a satellite reception scenario, any directionally sensitive reception scenario may be applicable.

Another example is the jamming of cell phone reception. A user could block the signals coming from the direction of the jammer but still use cells in other directions. An additional example is a communication network where signals in one direction have to be blocked to eliminate the disturbance of the jammer, but signals from sources in other directions can still be received.

The structural shell shown in FIGS. 1-3 is in turn supported in a manner that allows a change in its position relative to the antenna and thus allows the patch to be positioned where it can block or absorb some or all of the interfering electromagnetic radiation. The structural shell may be a solid surface or a non-solid surface, wires, faceted, and so forth, according to design preference.

Figure 4:
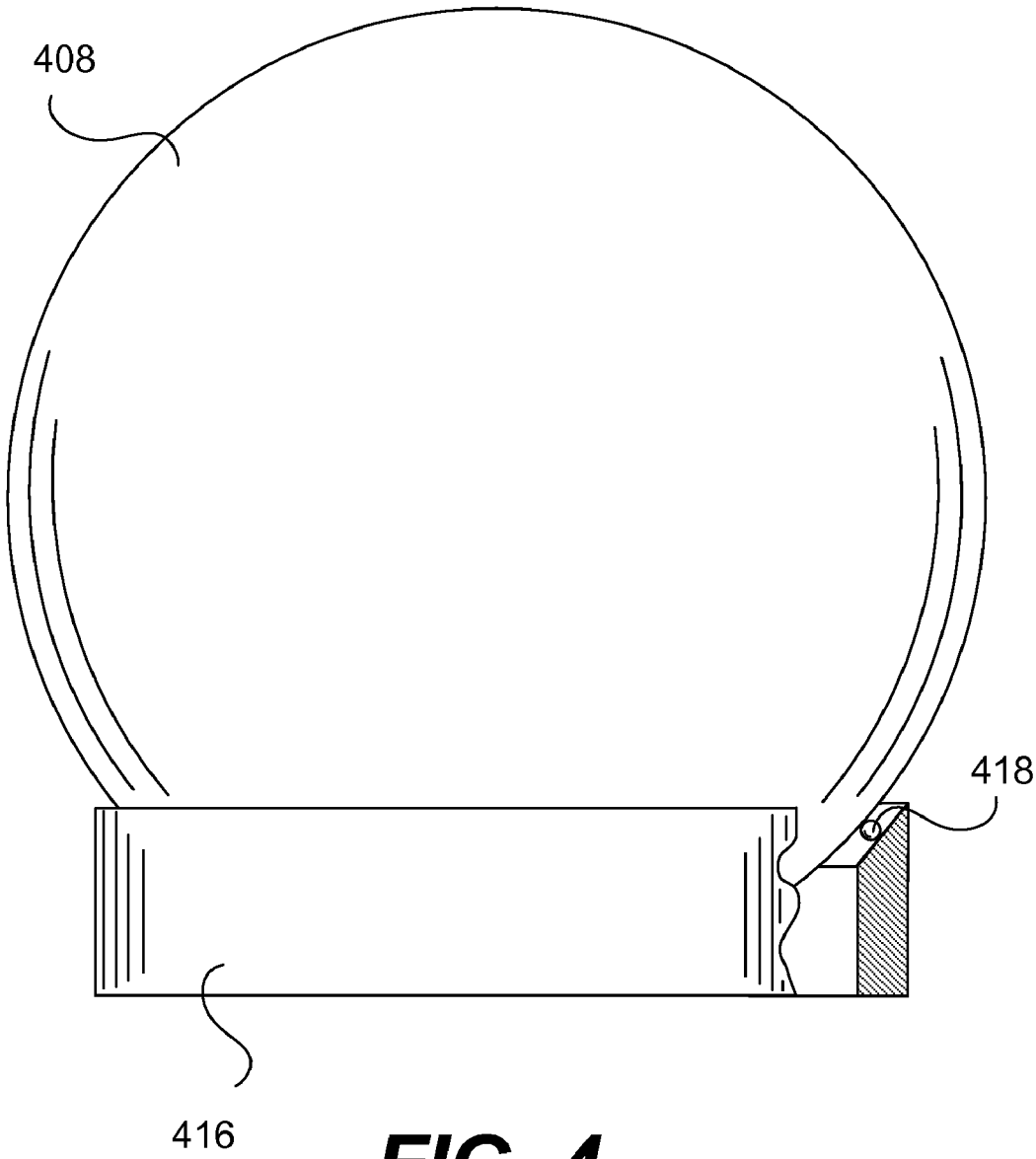
FIG. 4 shows a structural support shell resting on a cradle containing a ring of bearings in accordance with the VPAS described herein.

One method of supporting a structural shell 408 is to have it rest on bearings 418 as partially shown in FIG. 4. The bearings 418 may be held in place in sockets (not shown) attached to a cradle 416. The sockets may have a low friction contact surface. An alternative to the bearings 418 is to use a cradle 416 with the same contour as the structural shell 408 with the cradle surface supporting the structural shell 408. To reduce friction, there could be a thin film of fluid in the space between the structural shell 408 and cradle surfaces (not shown). The fluid could be oil or compressed air. This configuration is the same as FIG. 4 with a thin film of fluid replacing the bearing 418. In each of these cases, the structural shell 408 is able to rotate about any axis. One method of causing rotation of the structural shell 408 is by contact with positioning wheels (not shown), shortened here to be called "wheels". The contact friction force applied to the structural shell 408 in a direction tangent to the rim of the wheels provides the force to rotate the structural shell 408 when the wheels are turned by small motors either directly or through gears. There could be one or more wheels to cause rotation about an axis, which could be the vertical axis. Rotation about the vertical axis would be called "panning", which changes the azimuthal angle of the direction protected by the patch. Likewise, there could be one or more wheels to cause rotation about another axis, which could be the horizontal axis. Rotation about the horizontal axis would be called "tilting", which changes the elevation angle of the direction protected by the patch. Other axes could be chosen for rotation.

By suitable panning and tilting, the patch can be positioned anywhere within the useful range of the system. Any azimuthal angle can be achieved. In the case of an antenna system being supported by a vertical rod or beam, the elevation angle is limited by geometry since the bottom of the structural shell is open to accommodate the antenna support. Therefore, the edge of the bottom opening in the structural shell can not be rotated beyond the antenna support. The limitation on elevation angle would not be a problem when jammers are near the horizon since they would be located a low elevation. The geometry of the VPAS can be designed to facilitate the range of elevation angles within which jammers are anticipated to be located.

Figure 5:
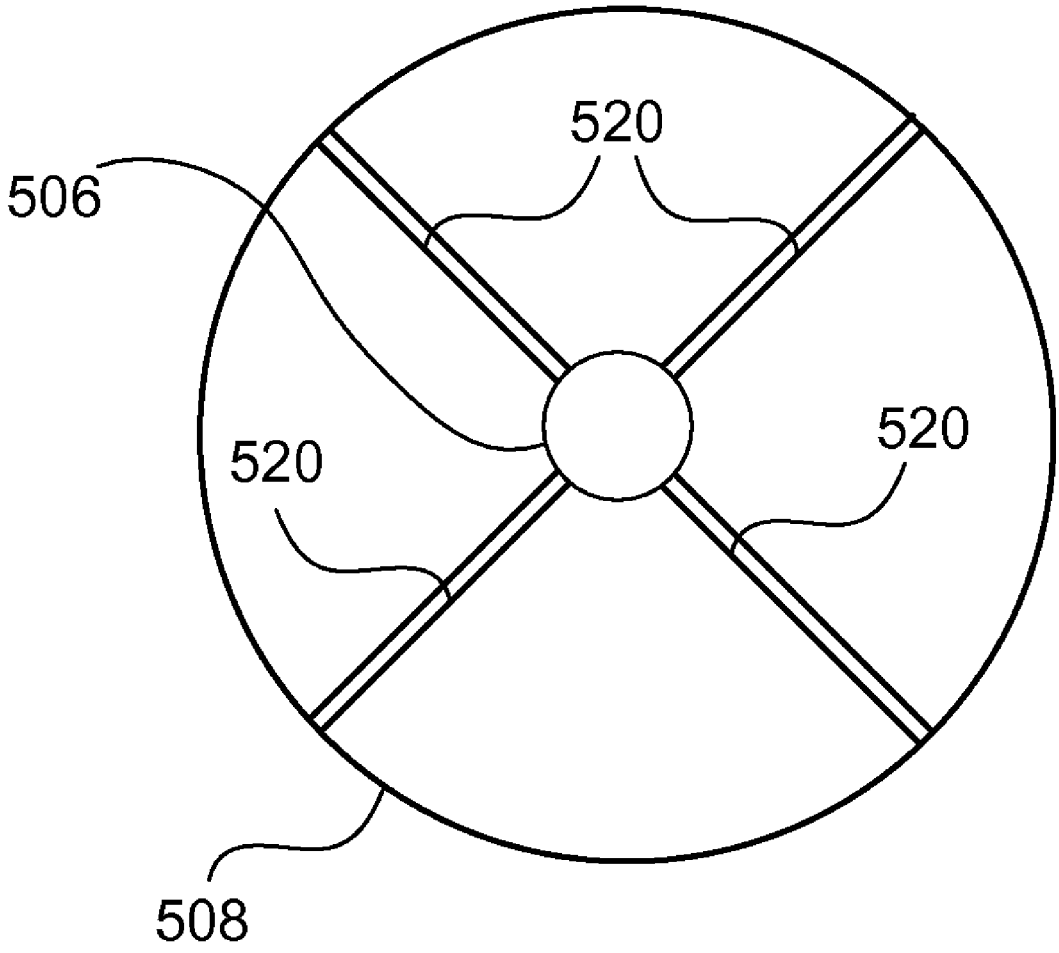
FIG. 5 is a horizontal cross-sectional view, showing an antenna system supported by struts to the interior of a structural support shell in accordance with the VPAS described herein.

The range of elevation angle rotation for VPAS operation could be increased by possible alternate embodiments that would avoid contact of the edge of the structural shell with the antenna support. An example is the use of struts to support the antenna system within the structural shell as shown in FIG. 5, which depicts a horizontal cross-sectional view. Struts 520 provide fixed support of the antenna system 506 and to the structural shell 508. In an alternate embodiment of FIG. 5, the struts 520 may be fixed to the antenna system 506 and in contact but not fixed to the structural shell 508. Therefore, rotation of the structural shell 508 about the antenna system 506 may be effected with the struts 520 providing a means for displacing the structural shell 508 from the antenna system 506, while enabling the structural shell 508 to "rotate" about the antenna system 506.

Generally speaking, if it is desired to extend the elevation angle of the patch beyond the tilt range of the structural shell, a temporary attachment of the patch to the structural shell can be used. One of several possible methods is to use an attaching means, such as, for example, Velcro® where strips of mating Velcro® are affixed to the structural shell and mating Velcro® is affixed to the patch. Another method would be to use a temporary adhesive or other means to affix the patch to different positions on the structural shell.

Figure 6:
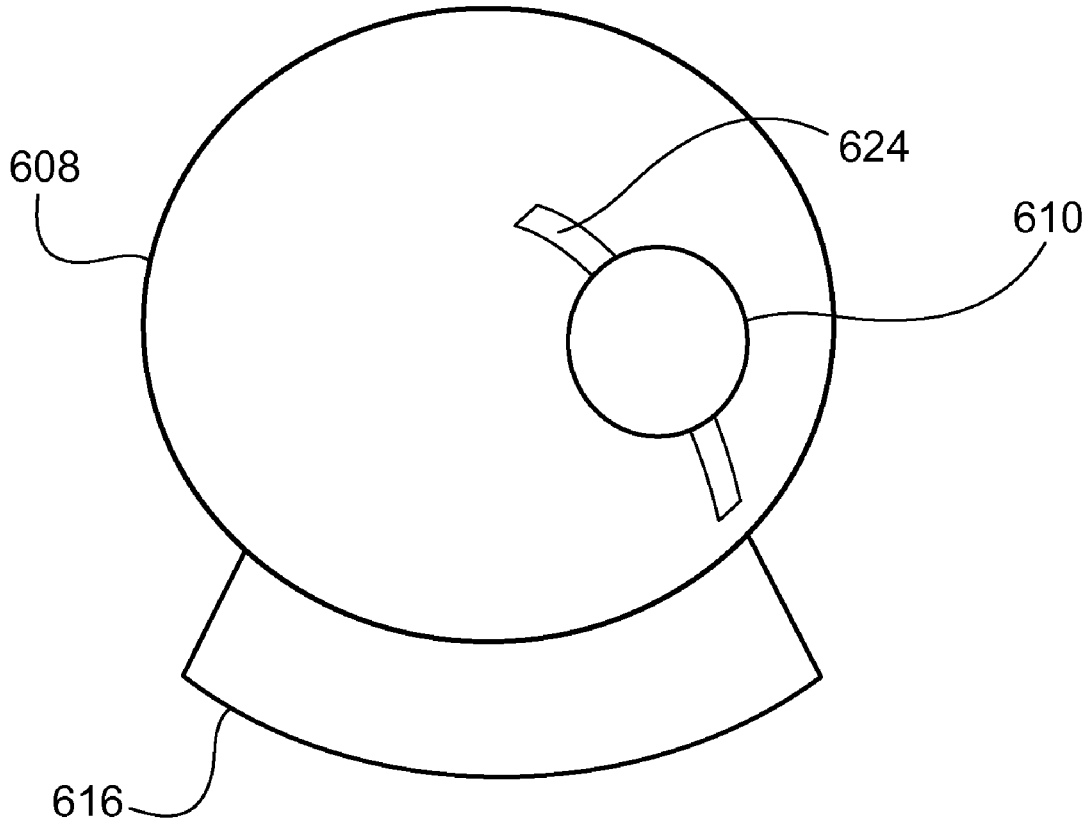
FIG. 6 shows a method of changing the elevation angle of the patch using a track in accordance with the VPAS described herein.

Another method to change the elevation angle of the patch is to use a track for patch attachment. A representation of this is shown in FIG. 6. The structural shell 608 is supported by cradle 616. A track 624 is affixed to structural shell 608. The patch 610 is positioned to slide along track 624 and caused to move along the track by means such as a small motor (not shown). The track 624 can be composed of a material, such as plastic, having minimal attenuation of the radio waves desired to be received or transmitted.

Another option is to eliminate change in elevation angle motion altogether for cases where the jamming signal is always going to be in a limited range of elevation angles. In that instance, a fixed elevation angle of the patch could be used or the elevation angle could be changed manually by moving the patch attachment point as previously described. If the capability of tilt motion variation is eliminated, the support structure need not be spherical. It could be a cylindrical shell with its bottom edge resting on a plate in turn resting on thrust bearings to support the weight of the structure and allow panning rotation. Other configurations are possible in which the panning capability is preserved.

By having the patch on a movable mechanism, its position can be varied in response to a relative motion between receiver and jammer. For example, the VPAS on a ship would respond to a ship changing course or rolling with ocean wave action. A similar capability could be achieved on moving land vehicles. Use of the VPAS on aircraft could be effective within the limitations of the elevation angle variation. Multiple VPAS units with different elevation angle ranges could be used on aircraft or other platforms to increase the effective elevation angle range by alternating instantaneous use of VPAS units to favor the one with a patch position that best reduces the jamming signal. A fixed site could use the VPAS to protect against a moving jammer.

The internal antenna of the VPAS could have a directivity pattern that is substantially omni-directional. In that embodiment, the position of the patch would be the only means to be able to alter the directivity of pattern of the entire antenna system. However, the VPAS does not preclude the use of additional methods to alter the directivity of the antenna system. Another embodiment could use an internal antenna with features that allow it to alter its directivity pattern independent of the position of the patch in the VPAS. In that instance, the VPAS would supplement the ability to change the directivity pattern of the entire system. For example, an antenna steering array or other antenna system with means of adjusting directivity may be enclosed within the VPAS. The array would perform its beam steering functions as if the VPAS were not present. Signals in a particular direction can be simultaneously attenuated by the VPAS as an aid to the antenna and thus reduce the impact of undesired electromagnetic radiation from that direction. It is conceivable there may be situations where either component (the steering array or the VPAS) acting alone may not be able to overcome the adverse effect of a high-powered jammer. When used together, the VPAS may attenuate the signal strength of the jammer at the antenna location enough to allow effective use of the antenna steering array to null out the signal from the jammer.

There could be multiple VPAS assemblies, which are used alternately to favor the one with the best functional position at any given time.

An alternate use of the VPAS is to affect directivity of a transmitting antenna. In this application, the VPAS would be a means to reduce the intensity of a transmitted signal radiated in a selected direction. In this case, the electromagnetic radiation being affected originates on the antenna side of the patch rather than from outside the VPAS as in the case for a receiving antenna system. The VPAS configuration is otherwise essentially the same as previously described. This application could be used by an aircraft in the close vicinity of other aircraft. The aircraft could transmit a strong radio signal while reducing the intensity in the direction of a nearby friendly aircraft so as to prevent overload of the nearby aircraft's receiver. The VPAS would serve as a means to affect transmitting intensity in a specific direction while the relative position of the two aircraft is changing. The VPAS with a transmitting antenna could be used in other applications where it is desired to reduce transmitting intensity in a variable direction. The patch reduces outgoing electromagnetic radiation from a transmitting antenna in selectable directions.

It will be understood that many additional changes in the details, materials, steps and arrangement of parts, which have been herein described and illustrated to explain the nature of the apparatuses and methods disclosed herein, may be made by those skilled in the art within the principal and scope of the apparatuses and methods disclosed herein as expressed in the appended claims. In particular, given the teachings provided herein, modifications to the shape of the structural shell and/or the patch may be made according to design preference. For example, the structural shell may be of a non-circular or non-spherical form, and the patch may be multiply located or of a non-strip form. Also, any form of the structural shell that conforms to a body of revolution in any axis may be used.

The previous description of the disclosed embodiments is provided to enable a person of ordinary skill in the art to make or use the apparatuses and methods disclosed herein. Various modifications to these embodiments will be readily apparent to those skilled in the art, and the generic principles defined herein may be applied to other embodiments without departing from the spirit or scope of this disclosure. For example, one or more elements can be rearranged and/or combined, or additional elements may be added. Thus, the present disclosure is not intended to be limited to the embodiments shown herein but is to be accorded the widest scope consistent with the principles and novel features disclosed herein.

What is claimed is:

1. A variable position antenna shield, comprising:

an antenna; and a patch variably positioned exterior to the antenna, wherein the patch attenuates passage of electromagnetic radiation such that the passage of electromagnetic radiation through the patch is substantially blocked, the patch being variably positioned to affect the directivity pattern of the antenna, wherein the patch is attached to a structural shell having an opening for an antenna system support.

2. The assembly of claim 1, wherein the structural shell has a shape corresponding to that of a body of revolution.

3. The assembly of claim 1, wherein the patch is attached using a temporary attachment mechanism, thereby allowing adjustment of a position of the patch on the structural shell.

4. The assembly of claim 1, wherein the structural shell is made of a material substantially transparent to the passage of radio waves.

5. The assembly of claim 4, wherein the structural shell material is one of glass or plastic.

6. The assembly of claim 1, wherein the patch is located below a line of sight of the antenna.

7. The assembly of claim 1, wherein the patch is located above a line of sight of the antenna.

8. The assembly of claim 1, wherein the structural shell is supported by bearings housed in a cradle.

9. The assembly of claim 1, wherein the structural shell is supported by a layer of fluid between the structural shell and the cradle.

10. The assembly of claim 1, wherein the structural shell is capable of rotating about at least one axis.

11. The assembly of claim 1, wherein the structural shell includes at least one hole.

12. The assembly of claim 1, wherein the patch is affixed to the structural shell by an adhesive.

13. A variable position antenna shield, comprising:

means for at least one of transmitting and receiving electromagnetic energy;

means for attenuating propagation of electromagnetic energy, the attenuating means being positioned exterior to the at least one of the transmitting and receiving means, and being variably positioned to affect a directivity of the at least one of the transmitting and receiving means; and a means for supporting the attenuating means, wherein the supporting means is rotatable about the at least one of the transmitting and receiving means.

* * * * *